US007205901B2

(12) United States Patent
Demster

(10) Patent No.: US 7,205,901 B2
(45) Date of Patent: Apr. 17, 2007

(54) REMOVABLE BATTERY AND ALARM SYSTEM

(75) Inventor: Stanley J. Demster, 8614 Woodland Ter., Lenexa, KS (US) 66220-3100

(73) Assignee: Stanley J. Demster, Lenexa, KS (US)

( * ) Notice: Subject to any disclaimer, the term of this patent is extended or adjusted under 35 U.S.C. 154(b) by 190 days.

(21) Appl. No.: 11/026,361

(22) Filed: Dec. 30, 2004

(65) Prior Publication Data

US 2006/0152376 A1 Jul. 13, 2006

(51) Int. Cl.
*G08B 21/00* (2006.01)

(52) U.S. Cl. ..... 340/636.1; 340/628; 340/635; 340/635.19; 340/630

(58) Field of Classification Search ..... 340/636.1, 340/628, 635, 636.19, 630, 635.19
See application file for complete search history.

(56) References Cited

U.S. PATENT DOCUMENTS 5,053,752 A * 10/1991 Epstein et al. ..... 340/628
5,612,678 A * 3/1997 Shibata ..... 340/628
5,793,295 A * 8/1998 Goldstein ..... 340/632
5,969,600 A * 10/1999 Tanguay ..... 340/438
7,046,156 B2 * 5/2006 Bergsten ..... 340/636.1

* cited by examiner

*Primary Examiner*—Jeffery Hofsass
*Assistant Examiner*—Edny Labbees
(74) *Attorney, Agent, or Firm*—Blackwell Sanders Peper Martin LLP

(57) ABSTRACT

The present invention relates to a removable battery system for a smoke detector having a low battery detection circuitry and an audible alarm. The system includes a pair of battery receivers each adapted to receive a battery therein and being electrically coupled to the low battery detection circuitry and the audible alarm wherein at least one of the batteries provides constant power to the low battery detection circuitry and the audible alarm. The system further includes a cover that is selectively movable to provide access to the battery receivers and a locking mechanism coupled to the pair of battery receivers wherein upon failure of one of the batteries received in the pair of battery receivers that provides constant power to the low battery detection circuitry and the audible alarm, the low battery detection circuitry sounds the audible alarm and selectively activates the locking mechanism to prohibit movement of the cover.

27 Claims, 6 Drawing Sheets

REMOVABLE BATTERY AND ALARM SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to an improved battery detection and alarm system, and more particularly to a removable battery system wherein upon failure of a battery, the failed battery must be replaced by a working battery before the audible alarm is silenced. The system may be used with any number of detection systems, some examples include smoke detectors, carbon monoxide alerting systems, and medical alerting systems. The following discussion, while relating specifically to smoke detectors, is not intended to limit the detection system.

The invention of the residential smoke detector has been proven a lifesaver countless times. However, experience with these devices has revealed a serious deficiency. Typical smoke detectors in the industry either have a single replaceable battery system or are powered by a power source contained in the residence or building where they are located.

The single replaceable battery system contains a single battery that upon failure emits a "chirping" sound to inform the user that the battery needs to be replaced. This design has the "human factor" problem in that the user must choose to replace the battery. However, the user may also choose to simply remove the battery to eliminate the "chirping" noise and, thus, the unit is rendered useless.

Another common design is a smoke detector that is powered by the buildings utility source. However, these units also suffer from a number of drawbacks. First, these systems also contain batteries that eventually fail and need to be replaced. Further, detectors powered from the building utility source may fail from utility interruption or wiring failure. Still further, systems that depend on remote power supplies or larger building wide control panels often contain complex backup power supervision systems to prevent loss of power supply. These types of systems are complex and very expensive.

Another design is the use of longer life batteries in the smoke detector. U.S. Pat. No. 5,444,434, August 1995, to Serby, discloses a smoke detector unit with a long life integral battery design with a claimed life up to 15 years. However, the device described by U.S. Pat. No. 5,444,434, to Serby, still contains a single battery that is not replaceable. Thus, if this battery fails, the device is no more usable than any other units with failed batteries.

Another design is the use of multiple power sources. However, the self-contained smoke detector used in residential applications must be simple, low cost, and easy to install and operate. No present art exits utilizing multiple power sources that is simple, low cost, and easy to install and operate. U.S. Pat. No. 5,574,436, to Sisselman, proposed adding a supplemental internal battery or capacitor to power the alarm function. However, this approach contains a number of deficiencies. First, the Sisselman design requires a non-replaceable battery that when fails or wears out renders the detector useless. Further, the Sisselman design requires recharging the non-replaceable battery from the replaceable battery, which diminishes the available power to the detector.

Thus, there remains a need for a detector alarm and a removable battery system that eliminates the "human factor" problem that is simple, low cost, and easy to install and operate. More specifically, there is a need in the smoke detector industry for a system that eliminates the "human factor" by providing an alarm system with a power source that is not silenced by simply removing a failed replaceable battery, only when the failed battery is replaced by a working battery.

BRIEF SUMMARY OF THE INVENTION

Accordingly, it is the object of the present invention to provide a removable battery system that solves the "human factor" problem.

It is a further object of the present invention to provide a removable battery system that is simple, low cost, and easy to install and operate.

Accordingly, the present invention provides a removable battery system that solves the "human factor" problem by providing an alarm that is not silenced by removing a failed replaceable battery. The detector of the present invention includes a single or dual replaceable battery system that provides a persistent audible alarm whenever the battery supply fails or if the replaceable battery is removed. With the multiple battery configurations, multiple batteries are contained in the battery compartments with a sliding enclosure that ensures continuous battery power by allowing only a single battery to be removed at a time and requires the replacement to be a working battery. With the single battery system, a single battery is contained in one of the battery compartments with a sliding enclosure that ensures continuous battery power by allowing a failing battery in one of the compartments to be removed once a working battery has been inserted in the other battery compartment. By providing a continuous audible alarm, the user may simply not ignore the device as the alarm recurs until a failed battery is replaced by a working battery.

Additional advantages, and novel features of the invention will be set forth in a description which follows, and will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
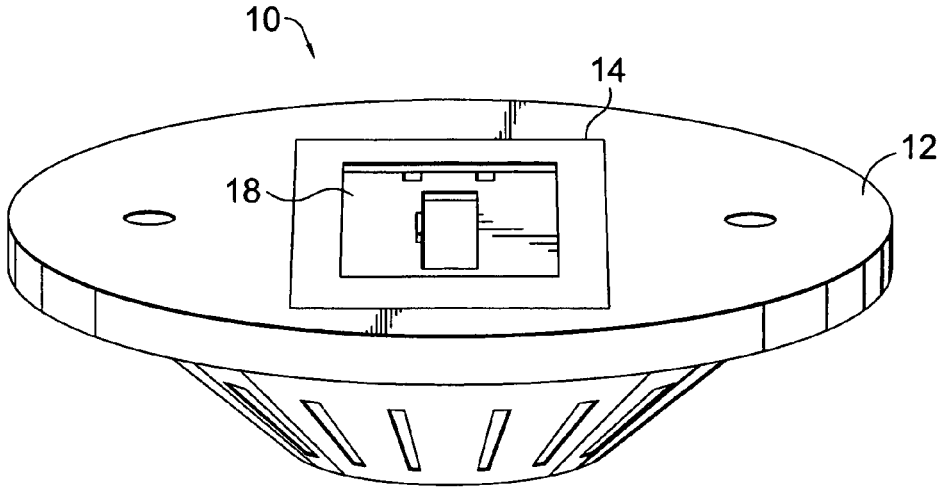
FIG. 1 is a perspective view of a smoke detector with a removable battery system.
Figure 2:
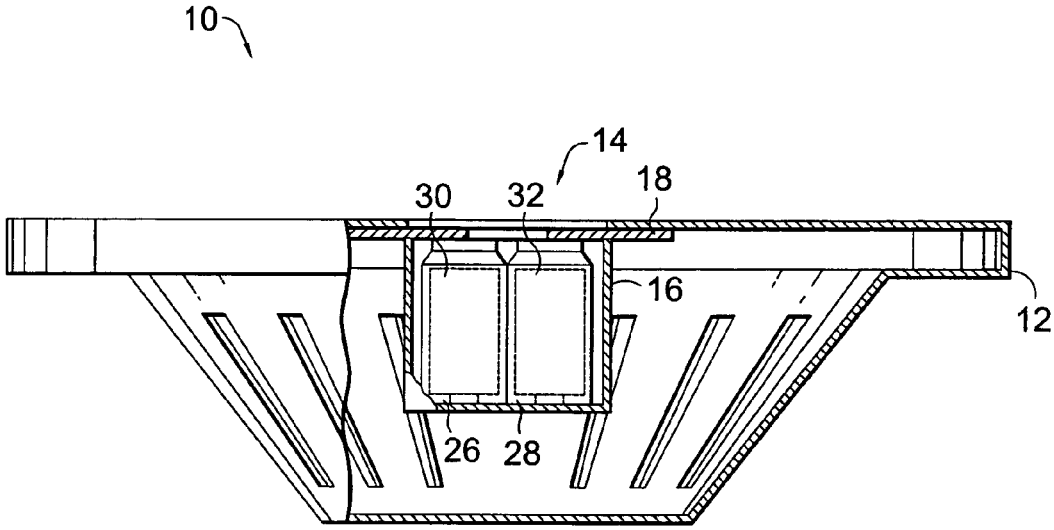
FIG. 2 is a side view of a smoke detector with parts being broken away to show particular details of construction.

Referring to the drawings in greater detail and initially to FIGS. 1 and 2, a smoke detector is shown and designated generally by the numeral 10. While the discussion is focused on a smoke detector, it will be appreciated by one of ordinary skill in the art that the removable battery system may be used in a number of detection and alarm systems. Smoke detector 10 includes a housing 12 and a removable battery system 14. Housing 12 is formed in the conventional manner, typically from injection molded plastic and is well known in the art. It should be understood that the housing 12 can be made from any other suitable material having similar characteristics.

Figure 3:
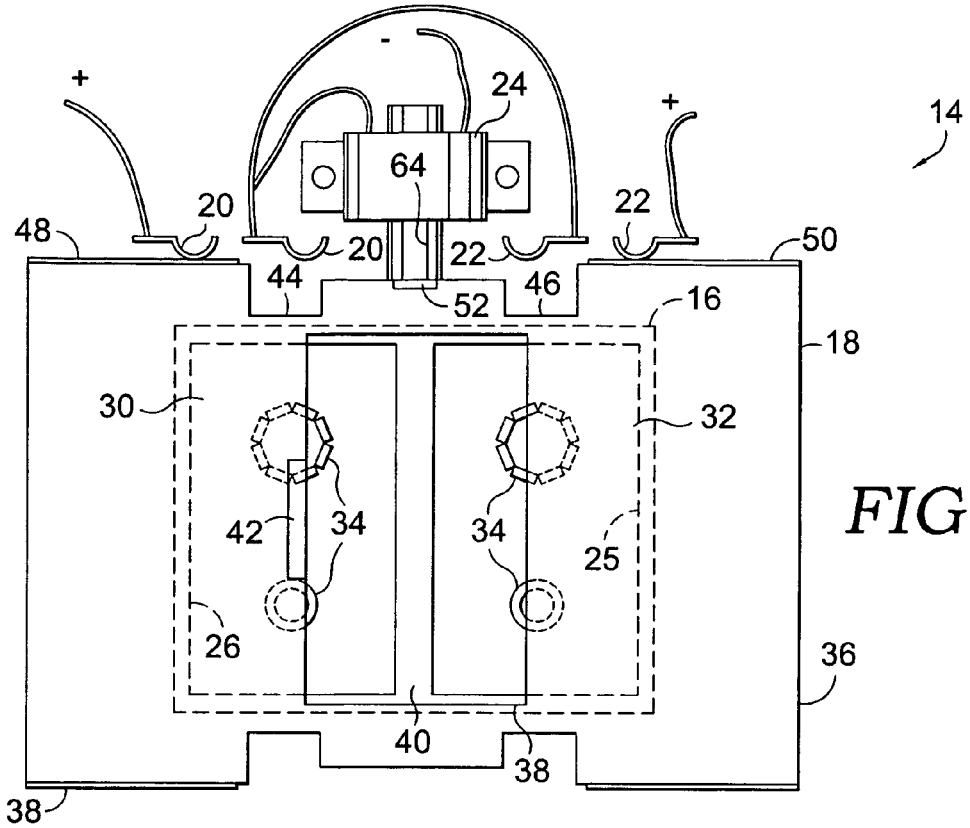
FIG. 3 is a top view of the removable battery system with cover in the working position.

As further illustrated in FIGS. 1–3, removable battery system 14 broadly includes a battery compartment 16, a sliding cover 18, a pair of electrical contacts 20, 22 and a cover solenoid 24. Battery compartment 16 consists of a pair of battery holders 26, 28. As best seen in FIG. 2, battery holders 26, 28 are generally box-like and are sized for receipt of a pair of batteries 30, 32. Battery holders 26, 28 contain polarized electrical contacts 34 and are configured as such so that batteries 30, 32 may not be improperly inserted. As seen in FIGS. 1 and 2, sliding cover 18 is slidably received within housing 12 to conceal battery compartment 16.

Referring now to FIG. 3, cover 18 is generally rectangular in nature with an outer edge 36 and an inner edge 38. The inner edge 38 is also generally rectangular in nature and defines an opening 40. Opening 40 is sized to only allow insertion of a battery in the correct orientation. Sliding cover 18 further includes a tab 42, positioning notches 44, 46, conductive metal strips 48, 50 and a positioning detent 52. Tab 42 is molded to cover 18 at inner edge 38 and extends outwardly to facilitate movement of cover 18. As further shown in FIG. 3, positioning notches 44, 46 are shown as generally rectangular recesses located on the perimeter of cover 18 at an intermediate position. Conductive metal strips 48, 50 are attached to the side of the cover 18 and are located near each end, the importance of which will be further described below. It will be appreciated that conductive metal strips 48, 50 can be made from any suitable conductive material as understood by one of ordinary skill in the art. The conductive metal strips 48, 50 on cover 18, when engaged with the electrical contacts 20, 22, form electrical switches 54, 56, the importance of which will be further described below.

Figure 7:
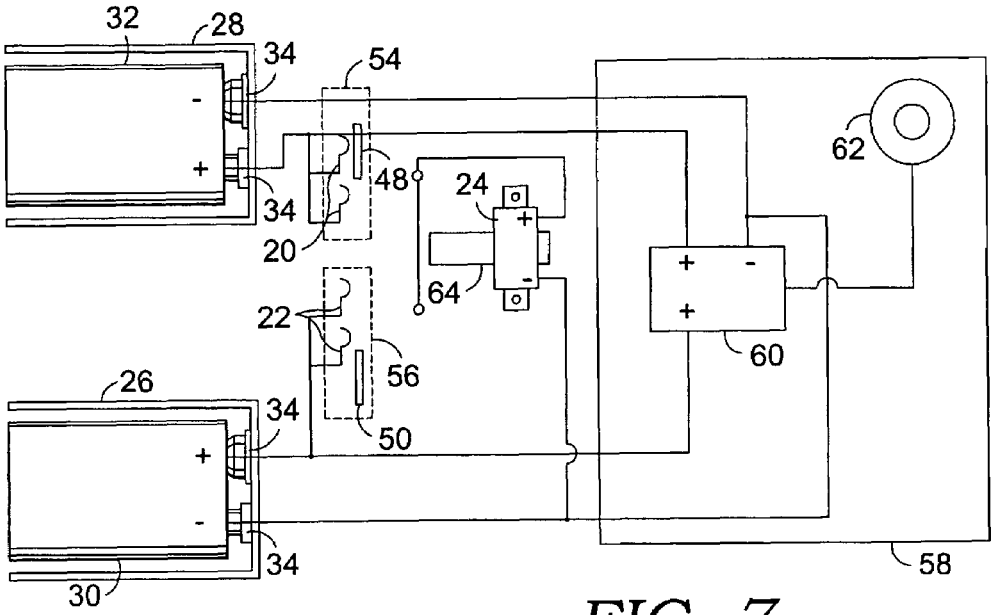
FIG. 7 is a perspective view of an electric block diagram.

Referring now to FIG. 7, an electronic block diagram of the present invention is shown. The electric block diagram generally consists of the pair of batteries 30, 32, connected to the contacts 34 in the battery holders 26, 28, a pair of battery test switches 54, 56, a circuit board 58, and a cover solenoid 24. Circuit board 58 further includes smoke detector circuitry 60 and an audible alarm device 62, both of which are well known in the art. Smoke detector circuitry 60 is well known in the art and generally includes an emergency smoke detector function such as a low battery indicator, not shown. Other smoke detector circuitry exists, specifically ionization, photoelectric, temperature, or carbon monoxide concentration detectors; however, it is not included as it is not pertinent to this discussion.

The smoke detector circuitry 60, i.e., the low battery indicator, monitors the available power of the batteries 30, 32 and activates the audible alarm 62 if the voltage of either of the batteries 30, 32 is deemed to be inadequate. Typically, to warn of a low battery condition, the audible alarm device 62 emits a "chirping" noise or other distinct recognizable sound. Some detector embodiments have voice alarms that provide a spoken indication of the low battery condition.

Referring again to FIG. 7, batteries 30, 32 are electrically coupled to both the electrical switches 54, 56 and the smoke detector circuitry 60 in a manner well known in the art. Batteries 30, 32 supply power to circuit board 58 that contains the smoke detector circuitry 60. The cover solenoid 24 is electrically coupled between the electrical switches 54, 56 and the smoke detector circuitry 60 in a manner well known in the art. Cover solenoid 24 is well known in the art and includes an armature 64.

Figure 4:
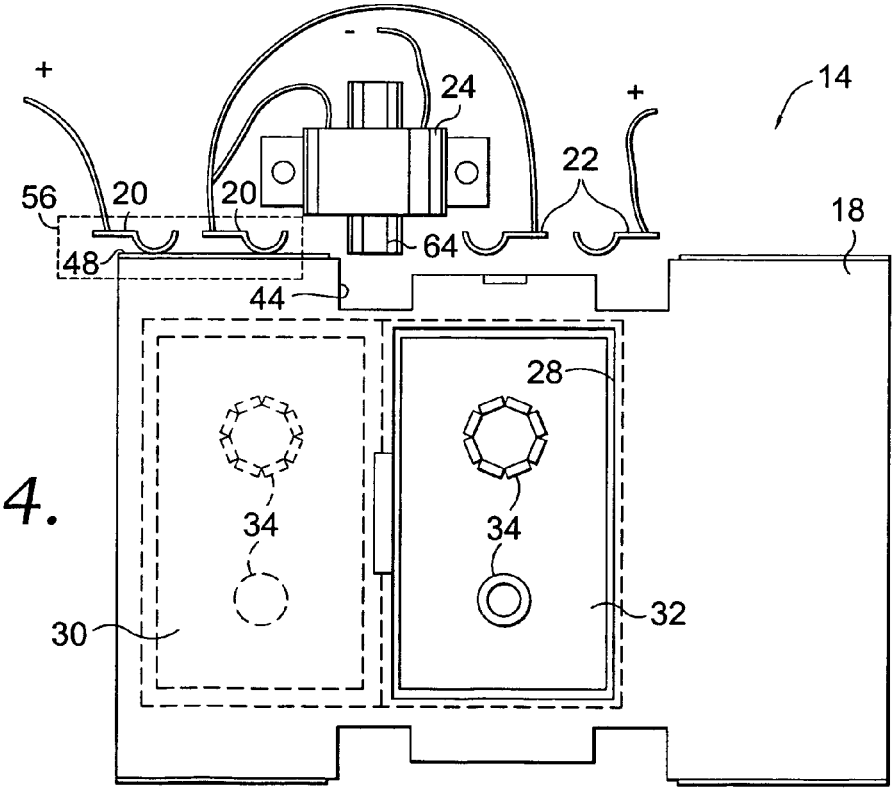
FIG. 4 is a top view of the removable battery system with cover indexed to the right position and solenoid armature energized.

It is appreciated by one of ordinary skill in the art that when viewing FIGS. 4 and 7, that the contacts 20 and the conductive metal strip 48 on the left portion of the cover 18, along with the battery 32 in the right battery compartment 28, combine to create the switch 56. When viewing FIGS. 5–7, the contacts 22 and the conductive metal strip 50 on the right portion of the cover 18, along with the battery 30 in the left battery compartment 26, combine to create the switch 54.

Figure 5:
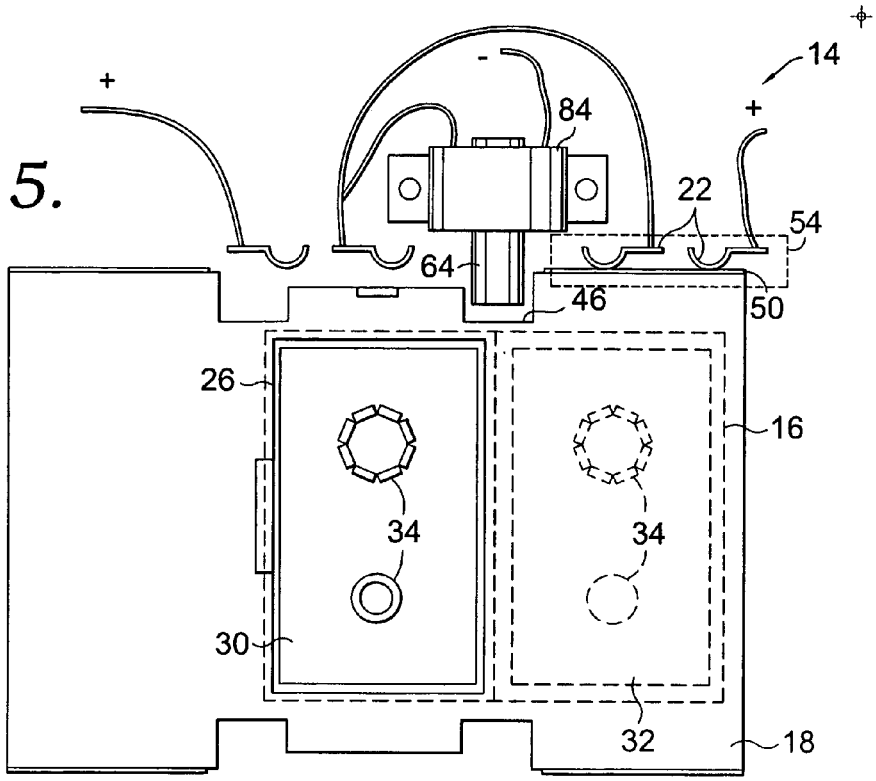
FIG. 5 is a top view of the removable battery system with cover indexed to the left position and solenoid armature de-energized.
Figure 6:
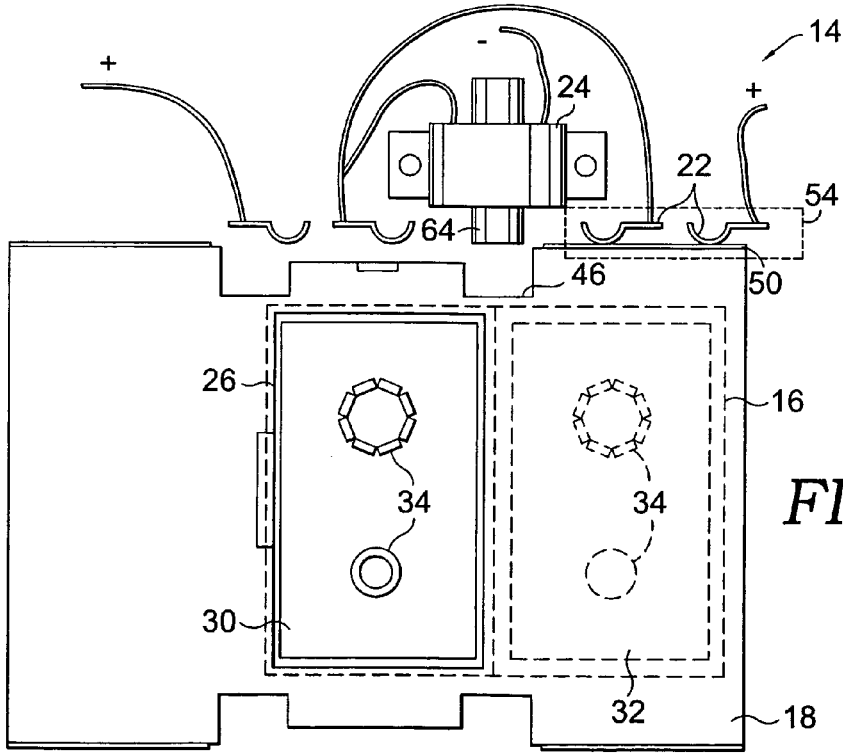
FIG. 6 is a top view of the removable battery system with cover indexed to the left position and solenoid armature energized.

Referring now to FIGS. 3–6 the removable battery system 14 is shown. The housing 12 has been removed for clarity. FIG. 3 shows the removable battery system 14 with sliding cover 18 in its working position and with armature 64 of solenoid 24 de-energized and engaged with positioning detent 52. FIG. 4 shows the removable battery system 14 with sliding cover 18 indexed to the right and with armature 64 of solenoid 24 energized and disengaged from positioning notch 44. FIG. 5 shows the removable battery system 14 with sliding cover 18 indexed to the left with armature 64 of solenoid 24 de-energized and engaged with positioning notch 46. FIG. 6 shows the removable battery system 14 with sliding cover 18 indexed to the left and with armature 64 of solenoid 22 energized and disengaged from positioning notch 46. The importance of each of the above configurations will be discussed further below.

Referring now to FIGS. 3–6, the operation of the removable battery system 14 will be described. As best seen in FIG. 3, smoke detector 10 is shown in its working position where with cover solenoid 24 is in its de-energized position with its armature 64 engaged with the positioning detent 52 to provide resistance to movement. Working batteries 30, 32, shown in FIG. 2, have been properly inserted in battery compartments 26, 28 and smoke detector is functioning.

When the smoke detector circuitry 60 indicates a low battery voltage condition, it activates the audible alarm device 62, which emanates a "chirping" noise to warn of the condition. At this point the user must replace the failed battery with a working battery in order to eliminate the "chirping." The user must either index the cover 18 to right or the left to gain access to the batteries 30, 32. Referring now to FIG. 4, the removable battery system 14 is shown with the cover 18 indexed to the right. When the cover is indexed to the right to gain access to the battery holder 28, an electrical circuit or switch 56 is completed when the conductive strip 48 contacts the electrical contacts 20. If the battery 32 is of sufficient quality, the solenoid 24 will energize the armature 64, as shown in FIG. 4, and the cover 18 may then be indexed back to its working position as shown in FIG. 3. The audible alarm device 62 constantly emits the "chirping" sound since the failed battery has still not been replaced. Once the cover 18 is indexed back to the working position of FIG. 3, the conductive strip 48 loses contact with the electrical contacts 20 and the electrical circuit or switch 56 is broken. The solenoid 24 de-energizes the armature 64 and the de-energized armature 64 engages the detent 52 to provide minimal resistance to movement of cover 18, as shown in FIG. 3.

The user must then index the cover 18 to the left as shown in FIG. 5. When the cover 18 is indexed to the left to gain access to the battery holder 26, an electrical circuit or switch 54 is completed when the conductive strip 50 contacts the electrical contacts 22. If the battery 30 is of insufficient quality, the solenoid 24 will remain de-energized and the armature 64 will further extend and engage positioning notch 46 as shown in FIG. 5. At this point, the cover 18 cannot be indexed back to center until the failed battery is replaced by a working battery. Further, the audible alarm device 62 constantly emits the "chirping" sound since the failed battery has still not been replaced. Once the user replaces the failed battery with a working battery, the electrical circuit or switch 54 is completed and the solenoid 24 energizes the armature 64. Once the armature 64 is energized, it disengages from positioning notch 46, as shown in FIG. 6. The cover 18 may now be indexed back to its working position, shown in FIG. 3.

Additionally, if the failed battery is not replaced with a working battery that will sufficiently power the solenoid 24, the solenoid 24 will not energize the armature 64 to disengage it from the positioning notch 46 and the cover 18 may not be indexed back to the working position. Further, the audible alarm device 62 still constantly emits the "chirping" sound until the battery is replaced. Thus, the removable battery system 14 of the present invention allows the cover 18 to be moved only if a correctly inserted battery of sufficient charge is installed. The battery is tested by the solenoid to see if it contains sufficient charge to power the detector. If the battery fails, the armature 64 of the solenoid 24 will not retract and release the cover 18.

Still further, if the initial batteries inserted are not of sufficient charge, the solenoid will not energize. Thus, the user must initially install working batteries.

Figure 8:
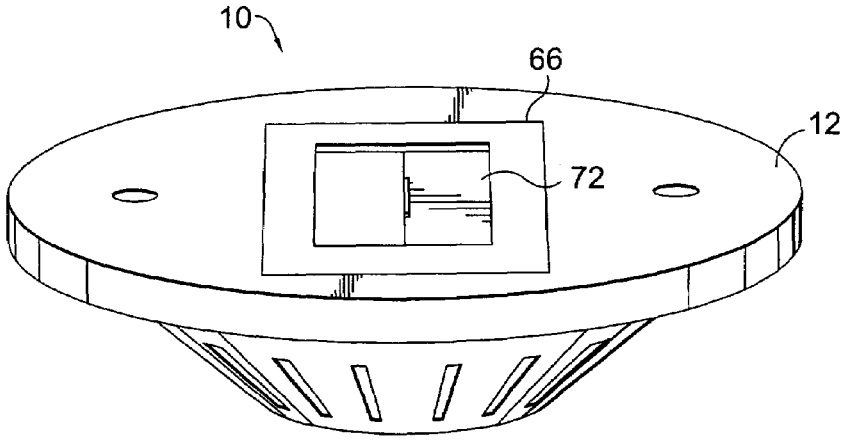
FIG. 8 is a second embodiment of the smoke detector with a removable battery system.

Another embodiment is shown with reference to FIGS. 8–11. Removable battery system 66 generally includes a pair of battery compartments 68, 70, a sliding cover 72, a pair of electrical contacts 74, 76, and a cover solenoid 78. Battery compartments 68, 70 are generally box-like and are sized for receipt of a battery 80. Battery compartments 68, 70 contain polarized electrical contacts 82 and are configured as such so that battery 80 may not be improperly inserted. As shown in FIG. 8, it will be appreciated that sliding cover 72 is slidably received within housing 12 as previously discussed with reference to FIG. 1.

Figure 9:
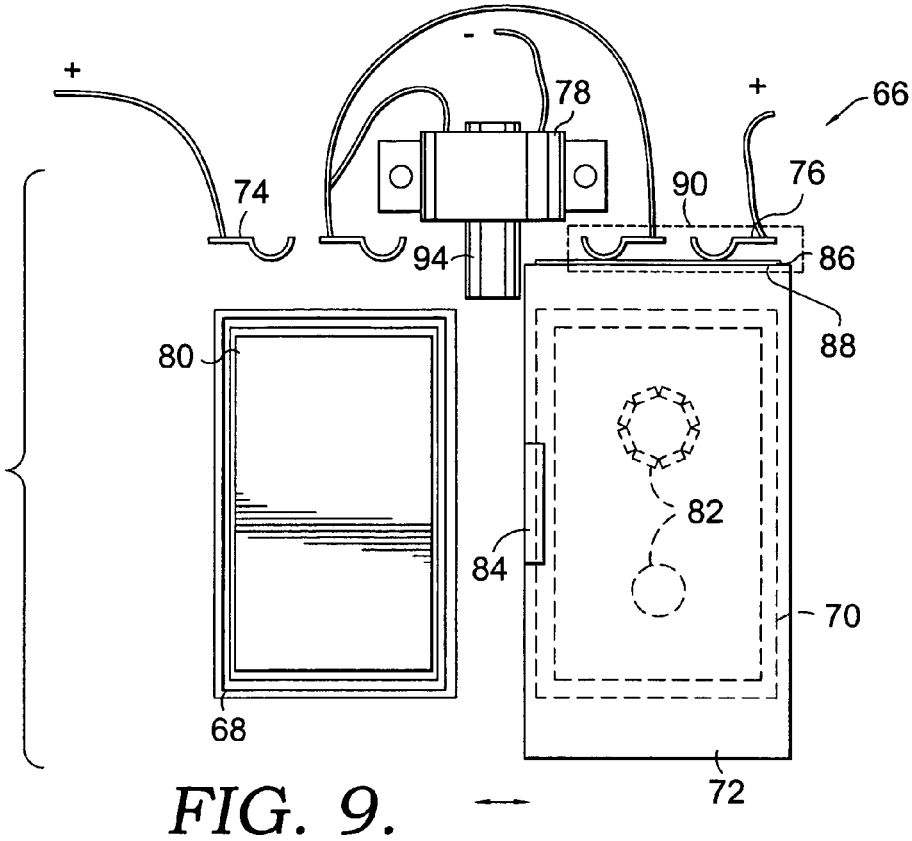
FIG. 9 is a top view of the second embodiment of the removable battery system with cover indexed to the right position and solenoid armature energized.

Referring now to FIG. 9, cover 72 is generally rectangular in nature and includes a tab 84 and a conductive metal strip 86. Tab 84 is molded to cover 72 at an intermediate location and extends outwardly to facilitate movement of cover 72. Conductive metal strip 86 is attached to a side 88 of the cover 72, the importance of which will be further described below. It will be appreciated that conductive metal strip 86 can be made from any suitable conductive material as understood by one of ordinary skill in the art. The conductive metal strip 86 on cover 72 when engaged with the electrical contacts 74, 76 form electrical circuits or switches 90, 92, shown in FIGS. 9–11, the importance of which will be further described below. Cover solenoid 78 contains an armature 94 as is well know in the art.

Figure 10:
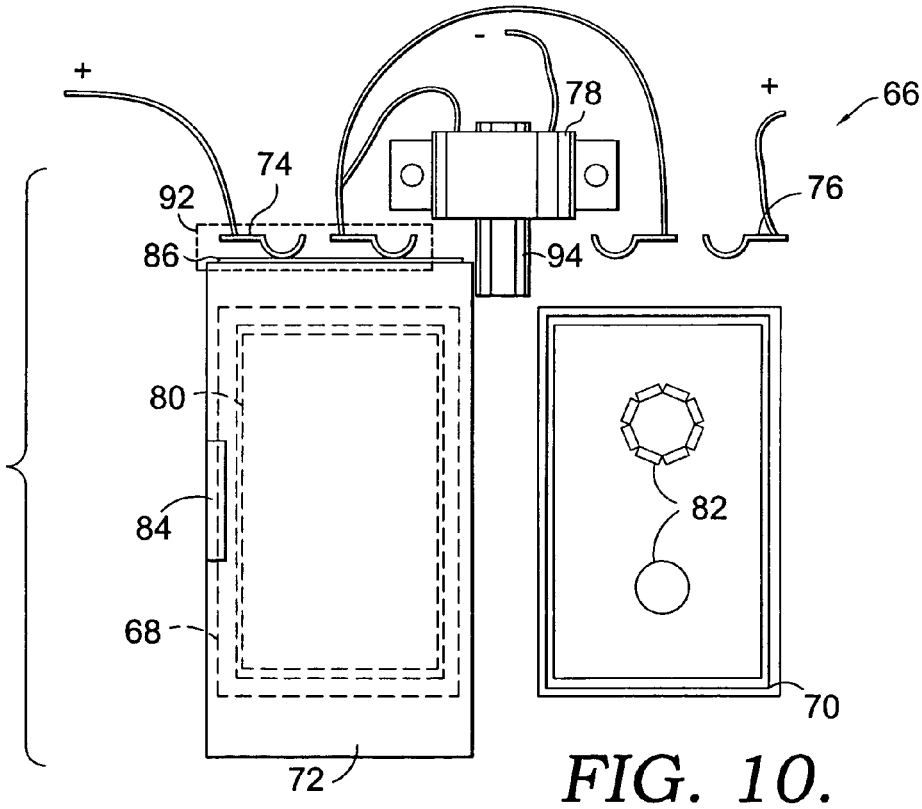
FIG. 10 is a top view of the removable battery system with cover indexed to the left position and solenoid armature energized.
Figure 11:
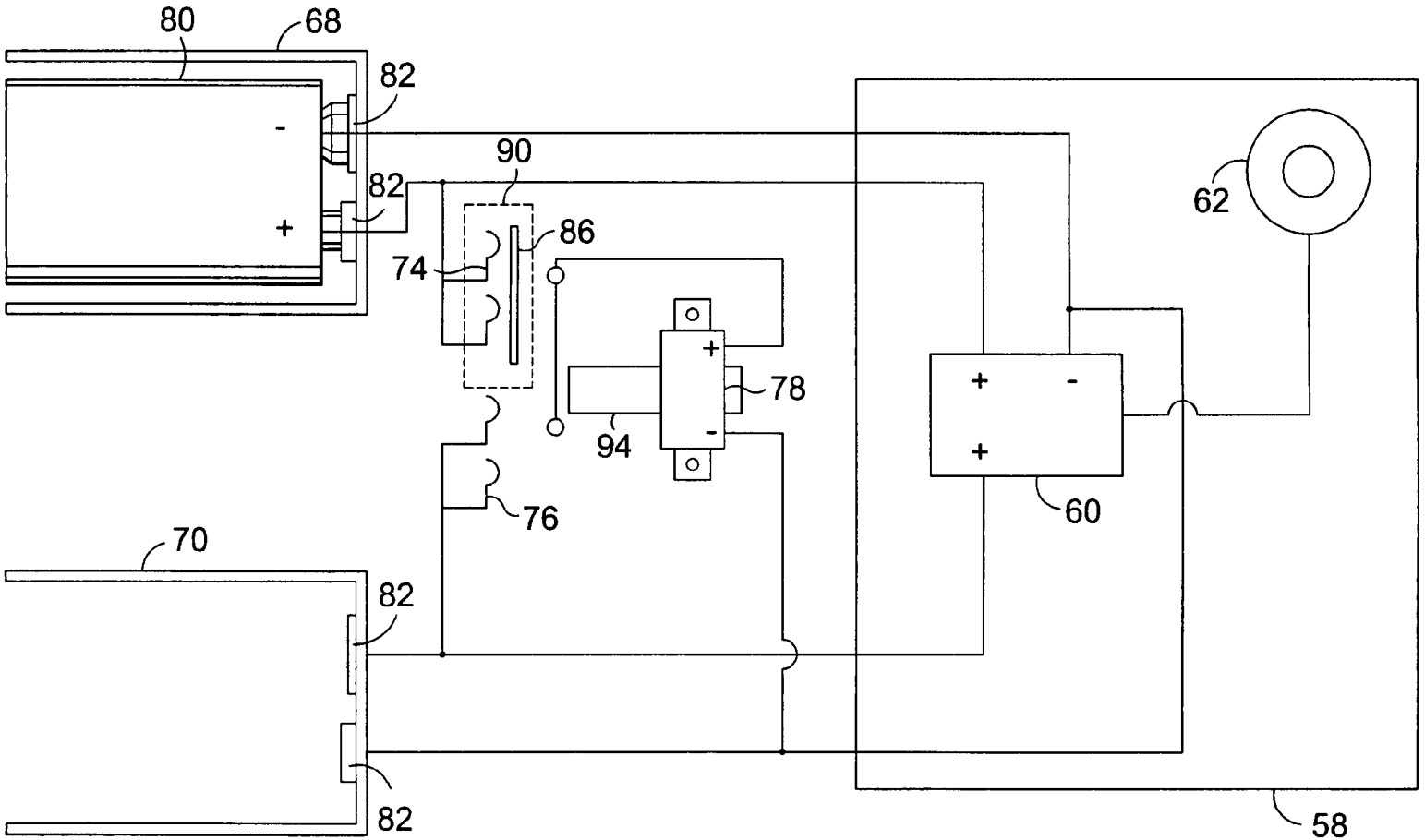
FIG. 11 is a perspective view of the second embodiment of an electric block diagram.

Referring now to FIGS. 9–11, a battery 80 has been inserted in a battery compartment 68. Cover 72 is indexed to the right to enclose battery compartment 70. The electrical contacts 76 and the conductive metal strip 86, along with the battery 80 create an electrical circuit or switch 90. If the inserted battery 80 is of proper charge and electrical circuit complete, the solenoid 78 will energize and the armature 94 will retract, not shown. The cover 72 may then be indexed to the left as shown in FIG. 10. Once the cover is indexed to the left, the electric circuit 90 is interrupted and the solenoid will de-energize and the armature 94 will extend. Since the cover 72 is indexed to left and the circuit interrupted, the extended armature 94 prevents the covered battery 80 from being removed. Upon failure of the battery 80, the smoke detector circuitry 60 indicates a low battery voltage condition. The smoke detector circuitry 60 activates the audible alarm device 62, which emanates a "chirping" noise to warn of the condition.

At this point the user must replace the failed battery 80 with a working battery, not shown, in order to eliminate the "chirping". In this embodiment, the user will simply add the battery, not shown, to the battery compartment 70. Once the battery, not shown, is added to the battery compartment 70, the electric circuit or switch 92 comprising the electric contacts 74, the battery, not shown, and the conductive metal strip 84 is complete. The completed circuit energizes the solenoid 78 and retracts the armature 94. The cover may be then indexed back to the right. Once the cover is indexed to the right, the electric circuit 90 is interrupted due to failed battery 80, and the solenoid 78 will de-energize and the armature 94 will extend.

As stated above, if the failed battery 80 is not replaced with a working battery that will sufficiently power the solenoid 78, the solenoid 78 will not energize the armature 94 to disengage and the cover 72 may not be moved to expose the other battery, not shown. The cover 72 will remain as shown in FIG. 10. Further, the audible alarm device 62 still constantly emits a "chirping" sound until the failed battery 80 is replaced. Thus, the removable battery system 66 of the second embodiment allows the cover 72 to be moved only if a correctly inserted battery of sufficient charge is installed. The battery is tested by the solenoid to see if it contains sufficient charge to power the detector. If the battery fails, the armature 94 of the solenoid 78 will not retract and release the cover 72.

This embodiment provides the same benefits as the previous embodiment without the need for a dual battery system. The "human factor" has been removed, as the cover will not permit the removal of a failed battery until a working battery has been inserted in a battery compartment.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A removable battery system having a low battery detection circuitry and an audible alarm, said system comprising:

a first battery receiver and a second battery receiver, each of the first and second battery receivers adapted to receive a battery therein and being electrically coupled to the low battery detection circuitry and the audible alarm, at least one of the batteries received in the first and second battery receivers providing constant power to the low battery detection circuitry and the audible alarm;

a cover being selectively movable to provide access to the first and second battery receivers; and a locking mechanism coupled to the first and second battery receivers;

wherein upon failure of one of the batteries received in the first and second battery receivers that provides constant power to the low battery detection circuitry and the audible alarm, the low battery detection circuitry sounds the audible alarm and selectively activates the locking mechanism to prohibit movement of the cover of the receiver containing a working battery until said failed battery is replaced.

2. The removable battery system of claim 1, wherein the audible alarm continuously sounds until a working battery is placed in the at least one of the first and second battery receivers that contains the at least one failed battery.

3. The removable battery system of claim 1, wherein upon failure of the battery received in one of the first and second battery receivers, the audible alarm continuously sounds until a working battery is placed in the other of the first or second battery receiver that does not contain the failed battery.

4. The removable battery system of claim 1, wherein the cover contains an opening for receipt of the battery.

5. The removable battery system of claim 4, wherein the cover contains a notch for receipt of the locking mechanism.

6. The removable battery system of claim 5, wherein the cover contains a tab.

7. The removable battery system of claim 6, wherein the cover has an electrical connection coupled thereto.

8. The removable battery system of claim 7, wherein the electrical connection is a conductive metal strip.

9. The removable battery system of claim 1, wherein the at least one failed battery comprises a single failed battery, the selective activation of the locking mechanism including allowing cover movement when the cover is positioned to allow full access to a battery of sufficient quality and prohibiting cover movement when the cover is positioned to allow full access to the failed battery.

10. The removable battery system of claim 1, wherein the at least one failed battery comprises a single failed battery, the selective activation of the locking mechanism including prohibiting cover movement until a working battery is received in one of the first and second battery receivers that does not contain the failed battery.

11. The removable battery system of claim 1, wherein the locking mechanism is a solenoid with a retractable armature.

12. The removable battery system of claim 1, wherein failure of the battery comprises the battery having a low voltage condition.

13. A removable battery system having a low battery detection circuitry and an audible alarm, said removable battery system comprising:

a housing;

a pair of battery receivers coupled to the housing, each of the battery receivers being adapted to receive a battery therein and being electrically coupled to the low battery detection circuitry and the audible alarm to provide constant power thereto;

a cover slidably coupled to the housing, said cover being selectively movable between the pair of battery receivers; and a locking mechanism coupled to pair of battery receivers;

wherein upon failure of the battery received in one of the battery receivers the low battery detection circuitry sounds the audible alarm and selectively activates the locking mechanism to prohibit movement of the cover of the receiver containing a working battery until said failed battery is replaced.

14. The removable battery system of claim 13, wherein the audible alarm continuously sounds until a working battery is placed in the other of the first or second battery receiver that does not contain the failed battery.

15. The removable battery system of claim 13, wherein the audible alarm continuously sounds until the failed battery is replaced by a working battery.

16. The removable battery system of claim 13, wherein the cover contains an opening for receipt of the battery.

17. The removable battery system of claim 16, wherein the cover contains a notch for receipt of the locking mechanism.

18. The removable battery system of claim 17, wherein the cover contains a tab.

19. The removable battery system of claim 18, wherein the cover has an electrical connection coupled thereto.

20. The removable battery system of claim 16, wherein the electrical connection is a conductive metal strip.

21. The removable battery system of claim 13, wherein failure of the battery comprises the battery having a low voltage condition.

22. The removable battery system of claim 13, wherein the locking mechanism is a solenoid with a retractable armature.

23. The removable battery system of claim 13, wherein selective activation of the locking mechanism includes allowing cover movement when the cover is positioned to allow full access to a battery of sufficient quality and prohibiting cover movement when the cover is positioned to allow full access to the failed battery.

24. The removable battery system of claim 13, wherein selective activation of the locking mechanism includes prohibiting cover movement until a working battery is received in one of the pair of battery receivers that does not contain the failed battery.

25. A removable battery system for a smoke detector having a low battery detection circuitry and an audible alarm, said removable battery system comprising:

a housing;

a first battery receiver and a second battery receiver, each of the first and second battery receivers adapted to receive a battery therein and being electrically coupled to the low battery detection circuitry and the audible alarm, at least one of the batteries received in the first and second battery receivers providing constant power to the low battery detection circuitry and the audible alarm;

a cover being selectively movable to provide access to the first and second battery receivers; and a locking mechanism coupled to the first and second battery receivers and including .an armature;

wherein upon failure of one of the batteries received in the first and second battery receivers that provides constant power to the low battery detection circuitry and the audible alarm, the low battery detection circuitry sounds the audible alarm and selectively moves the armature of the locking mechanism to prohibit movement of the cover of the receiver containing a working battery until said failed battery is replaced.

26. The removable battery system of claim 25, wherein the at least one failed battery comprises a single failed battery, the selective activation of the locking mechanism including positioning of the armature to allow cover movement when the cover is positioned to allow full access to a battery of sufficient quality and positioning of the armature to obstruct cover movement when the cover is positioned to allow full access to the failed battery.

27. The removable battery system of claim 25, wherein the at least one failed battery comprises a single failed battery, the selective activation of the locking mechanism including positioning of the armature to obstruct cover movement until a working battery is received in one of the first and second battery receivers that does not contain the failed battery.

* * * * *